US006387440B1

(12) United States Patent
Mantegazza et al.

(10) Patent No.: US 6,387,440 B1
(45) **Date of Patent: *May 14, 2002**

(54) METHOD FOR APPLYING A COATING TO A METAL SUBSTRATE OR REPAIRING A COATING APPLIED TO THE SAME

(75) Inventors: Claudio Mantegazza, Saronno; Emilio Zioni, Trezzano sul Naviglio, both of (IT)

(73) Assignee: DeNora S.p.A (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/910,189

(22) Filed: Jul. 20, 2001

Related U.S. Application Data

(62) Division of application No. 09/446,592, filed as application No. PCT/EP98/04270 on Jul. 9, 1998, now Pat. No. 6,287, 631.

(30) Foreign Application Priority Data

Jul. 10, 1997 (IT) ..... MI97A1643

(51) Int. Cl.[7] ..... B05D 5/12

(52) U.S. Cl. ..... 427/125; 427/348; 427/126.5; 427/349; 427/542; 427/383.7

(58) Field of Search ..... 427/125, 348, 427/126.5, 542, 349, 383.7

(56) References Cited

U.S. PATENT DOCUMENTS

| | | | | | |
|---|---|---|---|---|---|
| 3,684,543 | A | * | 8/1972 | de Nora et al. | 117/2 |
| 3,778,307 | A | * | 12/1973 | Beer et al. | 117/221 |
| 4,088,558 | A | * | 5/1978 | Fabian et al. | 204/288 |
| 4,554,172 | A | * | 11/1985 | Harrison | 427/12 |
| 5,948,222 | A | * | 9/1999 | Chen et al. | 204/290 F |
| 6,287,631 | B1 | * | 9/2001 | Mantegazza et al. | 427/125 |

* cited by examiner

*Primary Examiner*—Brian K. Talbot
(74) *Attorney, Agent, or Firm*—Bierman, Muserlian and Lucas

(57) ABSTRACT

The invention describes a method for applying an electrocatalytic or a protective coating to a metal substrate or repairing a damaged area of the same, consisting in a thermal treatment of a precursor of said catalytic coating by means of a hot air jet from a blower. The temperature of the substrate is locally controlled by means of surface temperature sensors or by an infrared measuring system. The metal substrate may be an exhausted electrode structure, in which case the reactivation is easily carried out at the plant site without any need of sending the structure to the producer. The method of the invention is particularly useful for reactivating anodes for oxygen evolution as it permits to avoid the risky procedure of detaching the anode from the current conductor.

4 Claims, No Drawings

METHOD FOR APPLYING A COATING TO A METAL SUBSTRATE OR REPAIRING A COATING APPLIED TO THE SAME

This application is a division of U.S. patent application Ser. No. 09/446,592 filed Dec. 21, 1999, now U.S. Pat. No. 6,287,631, which is a 371 of PCT/EP98/04270 filed Jul. 9, 1998.

The use of electrodes obtained by coating a valve metal substrate (for example titanium, zirconium, niobium, tantalum) with an electrocatalytic paint is known for use in different application fields. These electrodes may be useful in several electrolytic processes; for example for the evolution of chlorine from sodium chloride brine, as anodes for oxygen evolution in electrometallurgical processes or anodes for cathodic protection.

U.S. Pat. No. 3,632,498 describes a general method for the production of this type of electrodes, which consists in applying to the valve metal a precursor, that is a paint containing the electrocatalytic components in ionic form, which is converted into the catalyst by means of a thermal treatment in air (activation). The temperatures required for the conversion may be extremely high (300–800° C.). The most common method for the industrial production of these electrodes foresees, after the application of each paint layer, heating in oven at high temperature. As these electrodes usually have a very large size, the ovens have a great thermal mass which involves high production costs and severe problems due to the need of maintaining a homogeneous temperature profile throughout the whole volume. The electrodes usually comprise a frame for anchoring to the electrochemical cells wherein they are to be used. During heating in oven it is the whole electrode structure that undergoes the thermal treatment with the consequent waste of the energy used to heat unnecessarily the frame of the electrode. However, the most severe disadvantage is represented by the distortions caused by said treatment to some particularly critical areas, such as welding and connection points

STATE OF THE ART

The use of electrodes obtained by coating a valve metal substrate (for example titanium, zirconium, niobium, tantalum) with an electrocatalytic paint is known for use in different application fields. These electrodes may be useful in several electrolytic processes, for example for the evolution of chlorine from sodium chloride brine, as anodes for oxygen evolution in electrometallurgical processes or anodes for cathodic protection.

U.S. Pat. No. 3,632,498 describes a general method for the production of this type of electrodes, which consists in applying to the valve metal a precursor, that is a paint containing the electrocatalytic components in ionic form, which is converted into the catalyst by means of a thermal treatment in air (activation). The temperatures required for the conversion may be extremely high (300–800° C.). The most common method for the industrial production of these electrodes foresees, after the application of each paint layer, heating in oven at high temperature. As these electrodes usually have a very large size, the ovens have a great thermal mass which involves high production costs and severe problems due to the need of maintaining a homogeneous temperature profile throughout the whole volume. The electrodes usually comprise a frame for anchoring to the electrochemical cells wherein they are to be used. During heating in oven it is the whole electrode structure that undergoes the thermal treatment with the consequent waste.

of the energy used to heat unnecessarily the frame of the electrode. However, the most severe disadvantage is represented by the distortions caused by said treatment to some particularly critical areas, such as welding and connection points among different parts. Electrodes with a thin layer of a catalyst which coats the valve metal offer the main advantage that at the end of the active lifetime there is no need for substituting the electrode but just providing for reactivation with a new catalytic paint, as described in British Patent No. 1.324.924.

The application of the coating is a simple procedure carried out by spraying, which could be made even at the plant site if it were not necessary to resort to large dimensions ovens capable of reaching the necessary high temperatures, a burden which most users cannot bear, also due to the fact that a large number of elements should be treated in order to justify the oven installation and operation costs. Therefore the exhausted electrodes are usually returned to the producers to be reactivated, with remarkable additional costs for shipping and packing of the same.

In many cases re-inserting the electrode into the production cycle requires further steps. This is the case, for example, with the anodes for oxygen evolution used in some electrometallurgical processes where it is extremely important that the whole surface operate at the same potential and where the ohmic drops of the electrode structure should be kept at very low values. For this reason a current conducting structure is welded onto the active surface of the electrode, which conductive structure consists of a metal having good conductive properties, for example, copper coated with a valve metal. In order to reactivate this type of electrodes, usually the current conductive structure must be detached, as it cannot undergo the thermal decomposition treatment at high temperature, due to the different expansion characteristics of the two metals. A high number of elements are severely damaged during the detachment and must be substituted. Further, welding of the current conductive structure to the electrode involves a strong risk of locally damaging the catalyst and must be carried out with particular care by highly qualified technicians. The application of paint onto a metal surface is not limited to the case of electrodes. A particular case is the application of catalytic paints to valve metals, as described in U.S. Pat. Nos. 4,082,900 and 4,154,897. These patents describe the application of a paints containing a first oxide of an element of the platinum group and a second oxide having special characteristics to inhibit corrosion. This type of coating is particularly useful for protecting localized areas, for example interstices and junctions where crevice corrosion could destroy the integrity of the element. As the thermal treatment is required only in these localized areas, the need to subject the whole element to a thermal treatment in oven strongly penalizes said application both under the economical and practical standpoints.

OBJECTS OF THE INVENTION

It is the main object of the present invention to overcome the prior art shortcomings by providing a method for applying an electrocatalytic or protective coating to a metal substrate comprising applying a precursor of said electrocatalytic or protective coating material to the surface of said metal substrate and subjecting the surface to a local thermal treatment by a hot air gun or blower to produce high temperature and keep it under continuous control. The control of the temperature of the metal substrate is made locally by means of surface temperature sensors or by means of infrared measuring systems.

The dimension of the surface heated by the air jet depends on the type of nozzle applied to the.blower and may vary from some square centimeters to some hundred square centimeters.

It is a particular object of the invention to provide a method for applying an electrocatalytic coating onto a substrate, which may consist of an exhausted electrode and which may be carried out at the plant site without any need for shipping the exhausted electrode structure to the producers. The method of the invention is particularly useful for reactivating anodes for oxygen evolution as it permits to avoid the risky operation of detaching the current conducting structure.

It is another object of the invention to provide a method not only for reactivating exhausted electrodes but also for treating new electrodes and elements which need a protective coating against corrosion, whereas flanges or gaskets are applied during assembling in the plant. It is a further object to provide a method for repairing a damaged area of a metal substrate, previously provided with a coating.

The invention will be better illustrated by means of some examples, which are not to be intended as a limitation of the same.

EXAMPLE 1

A solution made of:

620 ml n-butanol 40 ml HCl 36%

300 ml butyl titanate 100 g $RuCl_3$ was applied by electrostatic brushing to a titanium electrode structure having an active surface of 1 $m^2$, upon hot pickling in oxalic acid, cleaning in a ultrasonic bath and drying.

After each application of the paint, the electrode surface was heated by an air jet at 500° C. from a Leister blower, "Robust" 7.5 kW type, provided with a rectangular nozzle, 30 cm long and 1 cm wide. The treatment lasted about one hour and the temperature of the metal substrate was kept under control by an infrared system for local measurement.

The electrode thus prepared was used as an anode for the electrolysis of sodium chloride in a mercury cathode cell fed with 28% brine at a pH of 2.5 and a temperature of 80° C. The cell was inserted in an industrial circuit of cells equipped with commercial electrodes. The current density was 10 $kA/m^2$; the overvoltage of the electrode of the invention showed no significant difference with respect to the commercial electrodes.

EXAMPLE 2

Two zirconium bars having the same size were degreased and pickled for 8 hours in a 10% oxalic acid solution at 90° C. A paint having the following composition was then applied to the bars:

30 ml $TiCl_3$ dissolved in water 3 g anhydrous $FeCl_3$ 1 g $FeCl_2$

The first bar was subjected to thermal treatment in oven at a temperature of 600° C. for 2 hours. The second bar was subjected to a thermal treatment according to the method of the invention with a hot air jet at 600° C. using the same blower of Example 1, for about one hour, the only exception being the use of thermocouples to measure the temperature.

Each bar was connected to a cathodic protection system of steel structures buried in the soil and both bars correctly performed for above 1000 hours at a current density of 1000 $A/m^2$.

EXAMPLE 3

The titanium anodic flange of a bipolar element of a De Nora DD 350 membrane electrolyzer, potentially subject to crevice corrosion phenomena, was painted in three subsequent applications with a solution made of:

3 g $RuCl_3$ 1.74 g $H_2IrCl_6$ 390 mg $TiCl_3$ from a 4% by weight hydrochloric acid solution 1 ml 2-propanol After each application, only the painted portion was subjected to the thermal treatment according to the method of the invention with a hot air jet at 540° C. using the same blower of Example 1, for 25 minutes, the temperature of the metal substrate being kept under control by means of an infrared system for local measurement.

The element comprising the flange thus treated was inserted and operated in an experimental bipolar De Nora DD 350 electrolyzer comprising a second element, the anodic flange of which had not been subjected to any treatment against corrosion. After 3000 hours of operation the element protected by the catalytic paint did not show any corrosion phenomena. The anodic flange of the un-treated element appeared to be covered in localized areas by a pulverulent deposit which, from a chemical analysis, resulted to be essentially made of $TiO_2$.

EXAMPLE 4

The damaged coating of a flange of a bipolar element of a DD 350 electrolyzer was repaired as described hereinafter. The bipolar element came from an industrial electrolyzer disassembled after three years of operation for the substitution of a membrane. During the detachment of the gaskets, the protective coating of the titanium flange of one bipolar element came off in a limited corner area. After careful washing with demi water and drying, the damaged area was ground with corindone sand removing also a small quantity of the old coating along the periphery. After another washing and drying, the ground area was treated as described in Example 3. The new coating successfully overcome the adherence test carried out by applying a suitable scotch tape and then tearing it off. No appreciable amounts of coating were removed.

EXAMPLE 5

An anode for oxygen evolution, made of a titanium base activated by a catalytic coating and a current conducting structure made of copper coated with titanium and directed to minimizing the ohmic drops and therefore to keep the electrochemical potential of the anode uniform, was used in chromium plating processes and withdrawn at the end of the lifetime, degreased, sandblasted and pickled in a sulphuric acid solution. The anode was then reactivated according to the following procedure:

four repeated applications of a mixture made of 100 mg/ml $TaCl_5$ 150 mg/ml $IrCl_3.3H_2O$ in a 20% hydrochloric acid solution tip to obtaining a deposit of 1 $g/m^2$ of noble metal.

drying at 150° C. and thermal decomposition at 500° C., after each application of the above paint, by means of a hot air jet using the same blower of Example 1.

The electrode was re-inserted in the chromium plating bath, made of 300 g/l of $CrO_3$ and 4 g/l of $H_2SO_4$, wherein it worked continuously for 1500 hours with the same electrochemical performances as before deactivation.

The invention has been described making reference to specific embodiments thereof. However, it must be understood that modifications of the same are possible without departing from the spirit and scope of this invention. One with ordinary skill can make various changes and modifications to this invention to adapt it to the various uses and conditions. As such, these changes and modifications are properly, equitably and intended to be within the full range of equivalents of the following claims.

What is claimed is:

1. A method for applying an electrocatalytic coating to a metal substrate comprising applying a precursor of said electrocatalytic coating to a damaged area of the metal substrate previously provided with a coating and decomposing said precursor by means of a thermal treatment, said thermal treatment being carried out in correspondence of said damaged area of the metal substrate by means of a hot air jet coming from a gun or a blower.

2. The method of claim 1 wherein said metal substrate is an exhausted electrode structure.

3. The method of claim 2 wherein said exhausted electrode structure has a current conducting structure welded thereto.

4. The method of claim 3 wherein said exhausted electrode structure is an anode for oxygen evolution and said current conducting structure is made of copper.

* * * * *